United States Patent [19]

Adam

[11] Patent Number: 4,537,400

[45] Date of Patent: Aug. 27, 1985

[54] RACKET GRIP HAVING A GRIP STRIP

[75] Inventor: Günter Adam, Straubing, Fed. Rep. of Germany

[73] Assignee: Puma-Sportschuhfabriken Rudolf Dassler KG, Fed. Rep. of Germany

[21] Appl. No.: 627,526

[22] Filed: Jul. 3, 1984

[30] Foreign Application Priority Data

Jul. 5, 1983 [DE] Fed. Rep. of Germany ..... 3324144

[51] Int. Cl.[3] ..... A63B 49/08

[52] U.S. Cl. ..... 273/75; 273/81.5

[58] Field of Search ..... 273/75, 73 J, 81 D, 273/81.5, 81.6, 72 A, 72 R; 74/558, 551.9, 558.5; 145/61 K, 61 R; 280/821-823

[56] References Cited

U.S. PATENT DOCUMENTS

| | | | |
|---|---|---|---|
| 1,606,711 | 11/1926 | Levy | 273/81.5 |
| 1,781,290 | 11/1930 | Margrave | 273/81.5 |
| 2,721,741 | 10/1955 | Prendergast | 273/81.6 |
| 3,140,873 | 7/1964 | Goodwin | 273/81.5 |
| 3,311,375 | 3/1967 | Onions | 273/81.5 |
| 3,530,739 | 9/1970 | Meier | 74/558 X |
| 3,674,267 | 7/1972 | Hollis | 273/75 |
| 3,702,189 | | Galich | |
| 3,845,954 | 11/1974 | Case | 273/81.5 |
| 3,848,480 | 11/1974 | Oseroff | 273/81.5 X |
| 3,931,968 | 1/1976 | Hedberg | 273/75 |
| 4,015,851 | 4/1977 | Pennell | 273/81.5 X |

FOREIGN PATENT DOCUMENTS

| | | |
|---|---|---|
| 2106800 | 9/1971 | Fed. Rep. of Germany . |
| 1021278 | | United Kingdom . |

OTHER PUBLICATIONS

PCT Application No. PCT/AU81/00061 (International Publication No. WO 81/03284).

*Primary Examiner*—Paul E. Shapiro

*Attorney, Agent, or Firm*—Sixbey, Friedman & Leedom

[57] ABSTRACT

For the simple mounting of a grip strip on a grip of a tennis racket without devices that damage the grip, a slot is provided in the bottom end of the hand-grip into which a grip strip can be inserted edgewise and where it can be fixed by a structural part of the hand-grip which holds the end of the grip strip in coaction with a tensional pulling effect of winding of the grip strip about the periphery of the hand-grip.

28 Claims, 9 Drawing Figures

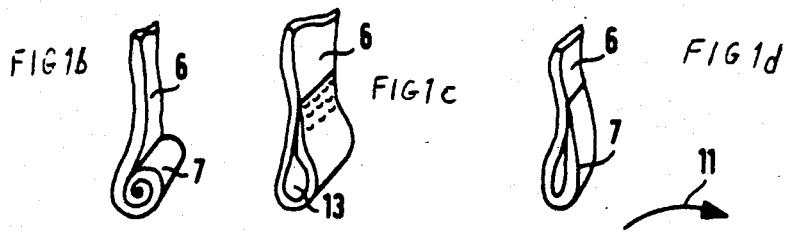
FIG. 1a
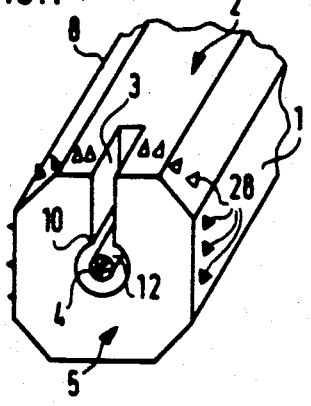
FIG. 2
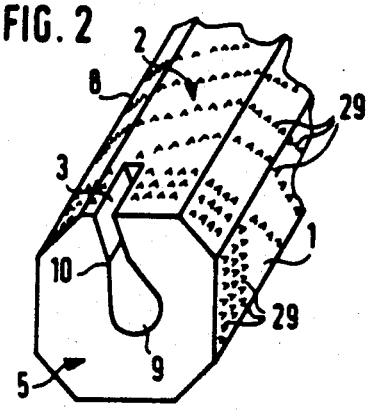
FIG. 3
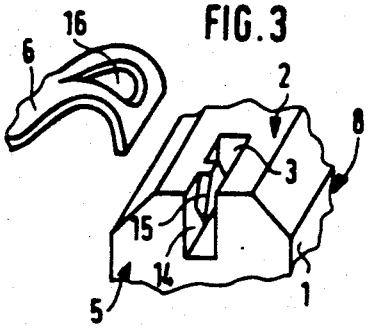
FIG. 4
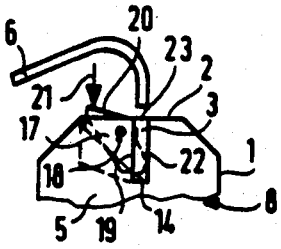
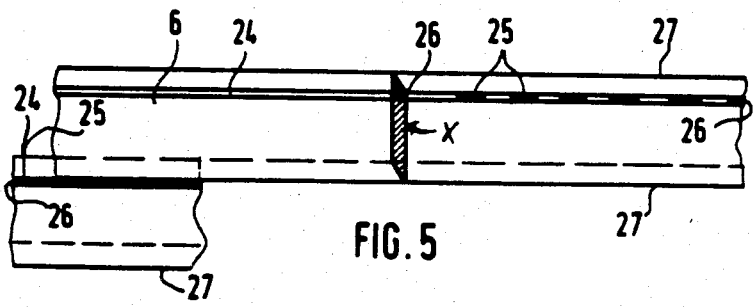
FIG. 5
FIG. 6
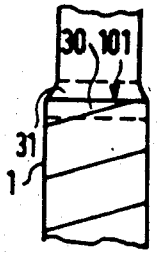

RACKET GRIP HAVING A GRIP STRIP

BACKGROUND AND SUMMARY OF THE INVENTION

This invention relates to a racket hand-grip having a wound grip strip that is mechanically attached, at one end, to the bottom of the hand-grip, in a detachable manner.

Grip strips are normally fixed to the bottom end of the hand-grip of a racket, especially a tennis racket, by means of a small steel or brass pin and are subsequently wound around the periphery of the handgrip. A nail is inserted also at the other end of the wound strip preventing detachment of the grip strip. By gluing the grip strip to the shaft of the racket frame, a slipping of the individual windings with respect to one another is also prevented. If the grip strip is changed frequently, the end of the hand-grip will gradually be damaged. This phenomenon of wear occurs especially when grips are used that are made of plastic, preferably foamed plastic.

It is, therefore, a primary objective of the present invention to provide a means by which this type of damage to the hand-grip may be avoided. In addition, it is also an object to enable the mounting of the grip strip to be carried out simply, rapidly and cost-effectively.

These objectives are achieved in accordance with features of preferred embodiments of the invention through the provision of a slot in the bottom end of the hand-grip into which an end of the grip strip is insertable and securable by a wedging or interior fastening means, as well as by provision of nonadhesive securing members on the periphery of the handgrip.

While it is known to mechanical fasten the end of a grip strip within a slot in an end of a hand-grip of a golf club as well as to provide a non-adhesive means for positionally securing the windings of the strip on the periphery of the hand-grip (U.S. Pat. No. 3,140,873), this known technique is relatively expensive, in practice, since it requires a special elastic grip strip with a metallic tip, and since it requires complicated molds to produce a required underlisting having a spiral strip receiving groove that widens inwardly to form a keyway for the grip strip. Furthermore, while such a hand-grip arrangement may provide an effective grip surface for a golf club handle, because of the fact that windings of the grip strip must be separated from each other by an exposed rib formed on the surface of the underlisting, such an arrangement may pose gripping problems if it were utilized on rackets for more active sports, such as tennis and racketball, wherein the player's hands are often wet with perspiration and his or her hand position is rapidly changing grip positions for serve, forehand and backhand strokes.

On the other hand, in accordance with the present invention no special metal tipped elastic grip is required nor is it required to utilize an expensive to produce, keyway-grooved underlisting. Moreover, the grip strip can be secured on the periphery of the handgrip without adhesives, yet adjacent windings of the grip strip need not be separated by less gripable unwrapped ribs. Furthermore, no separate pin or plug member is required to attach the end of the grip strip to the bottom of the racket hand-grip since, instead of a clamping or nailing-down of the end of the grip strip, the invention utilizes means, forming part of the hand-grip, to hold the end of the grip strip in conjunction with the tensional pulling effect of the winding of the grip strip about the hand grip.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1*a* shows an embodiment having a grip strip slot with a cylindrical enlargement, and FIGS. 1*b–d* each show a grip strip for use therewith;

FIG. 2 shows an embodiment having a grip strip slot with a wedge-shaped enlargement;

FIG. 3 shows an embodiment having a grip strip slot with an internal hook and grip strip for use therewith, prior to insertion;

FIG. 4 shows an enlargement having a grip strip slot with an internal wedging knee and an associated grip strip prior to insertion.

FIG. 5 is a top view of a portion of a grip strip according to the invention with a cross-sectional segment also being shown; and FIG. 6 shows a section of a handle of a racket at the top of its hand-grip.

DETAILED DESCRIPTION OF THE PREFERRED EMBODIMENTS

The bottom end portion 1 of a hand-grip 8 of, for example, a tennis racket handle 2, is provided with a perpendicularly extending slot 3 that terminates, on the inside, as a cylindrical enlargement 4. The slot 3, also, opens through the bottom wall 5 of end portion 1. The end of a grip strip 6 can be inserted in an edgewise manner into slot 3 through the opening formed in the bottom wall 5 into slot 3 and the enlargement 4. For the purpose of perfect fastening, the end of the grip strip 6 may be rolled up to form a thickened end 7 (FIG. 1*b*), or it may be simply turned up (FIG. 1*d*) and, if necessary, glued in addition, or it may be provided with a loop 13 (FIG. 1*c*). After insertion of its end into the slot 3 and enlargement 4, the grip strip 6 may be wound on the hand-grip 8 in either a spirally clockwise or counterclockwise direction. The location where the inner end of the parallel-walled portion of slot 3 meets the enlargement 4 has the reference numeral 10. The configuration of the slot and enlargement thus serve as a means, that is part of hand-grip 8, for holding the end of the grip strip 6 that is thickened by rolling, folding or looping, the holding action of which is facilitated by a wedging effect that will be produced by the tensional pulling produced by the windings of the grip strip.

FIG. 2 shows another slot arrangement for a racket grip according to the invention. Here, the slot 3 is provided with a wedge-shaped enlargement 9 into which the thickened end 7 is inserted which is obtained, for example, by the turning-up of the end of the grip strip (FIG. 1*d*). For a more improved fastening, the slot 3 is arranged to be angled in a diagonal fashion, so that in the case of a winding direction according to the arrow 11, in addition to the above-noted effects, a still better fastening of the end of the grip strip is obtained by the additional friction forces produced. Instead of the enlargement 9 being connected to the parallel-walled portion of the slot 3, the slot 3, as a whole, may inwardly widen in a wedge-shaped manner, so that a form of spline results.

The breadth of the slot corresponds approximately to the breadth of a grip strip 6; i.e., it is at least as broad as said grip strip 6, and the width of the slot corresponds to at least the thickness of a grip strip 6.

When a grip strip 6 with a loop is utilized (FIG. 1*c*), a pin 12 (FIG. 1*a*) may be provided in the enlargement 4 or in the enlargement 9. Thus loop 13 of the grip strip 6 may easily be hooked onto the pin 12 and may be held for the start of the winding, while the above-described effects are obtained as well. The slot 3 with the enlargement 4 or 9 and the pin 12 or a peg, in this case, form something like a keyhole. The loop 13 at the end of strip 6 may be formed, for example, by the corresponding turning-up of the strip end and the gluing and/or sewing-together thereof.

A further beneficial manner of fastening the end of grip strip 6 to the end of the hand-grip, in accordance with the invention, is shown in FIG. 3. There, a hook 15 is mounted on a lateral inside wall 14 of the slot 3. The hook 15 may, for example, be shaped onto the wall as a unitary formation when the hand-grip is made of plastic. The grip strip 6, in this case, has a correspondingly shaped recess 16, for example, a slot, a hole, an oblong hole or similar means in order to be able to be connected with the hook 15 in a form-locking manner. While a wedging effect of the type produced in the FIG. 1*a*, 2 embodiments does not occur, it will be appreciated that, by winding the strip in the direction indicated, the tensional pulling effect of the winding will act in conjunction with the form-locking recess and hook to hold the strip end upon the hook 15.

Another advantageous fastening of the grip strip 6 may be obtained if, at an inside wall 14 of the slot 3, a wedging knee 17 is provided that is mounted so that it can be swivelled around an axis 18. The wedging knee 17 has an inside leg 19 which projects into the slot 3 when the outer leg 20 does not project beyond the periphery of hand-grip 8 (broken line position of FIG. 4), but which lies at least approximately flush with the inside wall 14, when the outer leg 20 of the knee 17 projects upwardly as shown in its solid line position in FIG. 4. This second position is the one which enables one end of the grip strip 6 to be slid into the slot 3. In this case, the end of the grip strip 6 does not require special treatment; i.e., it does not require any thickening, loop, recess or similar means. After the grip strip 6 is inserted in the slot 3, it is, by means of pressure applied to the outer leg 20 of the wedging knee 17 in the direction of the arrow 21, clamped because of the fact that the inside leg 19 of the knee is swivelled toward the opposite inside wall 22 of the slot 3. This pressure is preferably generated by the grip strip 6 itself when it is pulled taut over leg 20 during winding in the direction shown. Advantageously, the wedging knee 17 is mounted in such a way that its angular edge 23 is at least almost flush with the grip side 2 and possibly also with the inside wall 14.

So that the grip strip 6 can be wound on the handgrip 8 easily and precisely, as shown in FIG. 5, the grip strip 6 is provided, on its visible side, with placement indicia such as a longitudinal imprint 24 and/or a longitudinal stamp 25 (darker sections, for example, darker longitudinal stamps 25, in FIG. 5 on the right of the representation of the cross section). These imprints or stamps may be continuous or applied at points or in sections. The placement indicia 24, 25 may, for example, also be used as a guideline during mechanical winding of the grip, for example, for optoelectronic scanning and mechanical control. In such a case, the placement indicia (longitudinal imprint 24 and/or the longitudinal stamp 25) extend directly along an upper edge 26 of a chamfering (see crosssectional detail X), in parallel to said chamfering edge 26 or in parallel to the longitudinal edges 27 of the strip 6, or on the left or the right of the chamfering edge 26. As the strip is wound about the hand-grip 8, the indicia 24, 25 may be completely, partly or not at all covered by the overlapping of the oppositely chamfered part of the adjacent side of the next winding turn (FIG. 5, left bottom).

According to another feature of the invention, the surface of the hand-grip 8 is provided with an integral tacking means in the form pinpoints 28 and/or a roughening in the nature rough points 29. The pinpoints 28 have a height of 0.1 to 0.7 mm, preferably, 0.1 to 0.5 mm, and the rough points 29 have a height of 0.05 to 0.3 mm. During the winding of the grip strip 6, the points of either form of tacking means will press into its underside and thus prevent a slipping of the windings of the grip strip 6.

The pinpoints 28 are provided at least as a surrounding line near the bottom wall 5 (FIG. 1), in order to ensure a good adhesion of the grip strip 6 at the start of the winding. Also, rough points 29 may be similarly located in the form of a strip-like surrounding roughening of this part of the grip (FIG. 2). It is also advantageous to so arrange a ring of tacking means at the top end 101 of the hand-grip 8, so that the winding end of the grip strip 6 is also securely anchored. In this regard, the end 30 of the grip strip, as shown in FIG. 6, is expediently cut in a wedge-shaped form so as to end in an acute angle. In addition to the tacking means, the grip strip may be fixed at the top 101 of the hand-grip 8 by means of adhesive tape or a rubber strip 31. Thus, the grip strip 6 no longer has to be glued to the strip 1 itself, so that it can be replaced easily, at any time.

Advantageously, tacking means in the form of the pinpoints 28 and/or rough points 29 may also be provided over the full length of the hand-grip 8, in longitudinal lines and/or circumferential lines and/or spirals, for example, at a slope corresponding to the slope of the spiral windings of the grip strip 6.

Even though the main field of application of the invention concerns tennis rackets, it may also advantageously be used in other types of racket, such as squash rackets, badminton rackets, racketball rackets, and other rackets.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A racket handle of the type having a grip strip fastened at the bottom end of a hand-grip of the racket handle, wherein the bottom end of the hand-grip is provided with a slot that projects inwardly from one side of the hand-grip, and opens through a bottom wall of the hand-grip an end of a grip strip being insertable edgewise into said slot through said bottom wall, and wherein means, comprising a structural part of said hand-grip, is provided for holding said end of the grip strip in co-action with a tensional pulling effect of winding of the grip strip about the periphery of said hand-grip.

2. A racket handle according to claim 1, where the means for holding comprises providing said slot with a cross-sectional enlargment at an inner end thereof for receiving a thickened portion of the end of the grip strip.

3. A racket handle according to claim 2, wherein the enlargement of the cross section is formed in a wedge-shaped manner that widens inwardly, whereby the thickened end of the grip strip can be wedged-in by said pulling-effect.

4. A racket handle according to claim 2, wherein a pin is located in the enlargement so as to receive a loop formed on the end of the grip strip when it is inserted therein.

5. A racket handle according to claim 4, wherein the slot extends perpendiculaly inwardly from said one side of the hand-grip.

6. A racket handle according to claim 2, wherein the breadth of the slot corresponds to at least the breadth of the grip strip and the width of the slot corresponds to at least the thickness of the grip strip.

7. A racket handle according to claim 6, wherein the slot and the enlargement thereof are formed in the manner of a keyhole having a peg or a pin upon which a loop of the grip strip can be slid.

8. A racket handle according to claim 2, wherein the end of the grip strip is turned up or rolled-up, to form the thickened end.

9. A racket handle according to claim 8, wherein said turned-up or rolled-up end is self-adhesive.

10. A racket handle according to claim 1, wherein one of a pin and a hook is provided within the slot, the end of the grip strip being hookable thereon.

11. a racket handle according to claim 10, wherein the breadth of the slot corresponds to at least the breadth of the grip strip and the width of the slot corresponds to at least the thickness of the grip strip.

12. A grip strip for a racket handle of the type set forth in claim 10 wherein the grip strip is provided with a loop for the hooking onto the hook or pin.

13. A grip strip for a racket handle of the type set forth in claim 10, wherein the grip strip is provided with a slot or a hole for the hooking of the hook or pin extending therethrough.

14. A racket handle according to claim 1, wherein the slot extends perpendicularly inwardly from said one side of the handgrip.

15. A racket handle according to claim 1, wherein the slot extends inwardly in a diagonally angled fashion from said one side of the hand-grip.

16. A racket handle according to claim 1, wherein the breadth of the slot corresponds to at least the breadth of the grip strip and the width of the slot corresponds to at least the thickness of the grip strip.

17. A racket handle according to claim 1 wherein the means for holding comprises a wedging knee mounted in association with said slot in a manner that can be swivelled so that: an angular edge is at least almost flush with the surface of the grip side; a first leg of the knee projects into the slot and can be swivelled between one wall of the slot and an opposite wall of the slot for insertion and engagement of the grip strip; and a second leg of the knee projects above said one side of the hand-grip when the first leg of the knee is swivelled into said one wall so as to unblock the slot, but is shiftable, by means of the grip strip, to a position substantially flush with said one side of the hand-grip, in which position, the first leg of the knee is shifted toward said opposite wall of the slot to wedge the end of the grip strip.

18. A grip strip for a racket handle of the type set forth in claim 1, wherein placement indicia in the form of at least one of a longitudinal imprint and a longitudinal stamp are provided on the grip strip in parallel to longitudinal edges thereof, and the distance of which from a longitudinal edge is dimensioned in such a way that the placement indicia serve as a marking for the winding of the grip strip on a racket grip.

19. A grip strip according to claim 18, wherein one side of the grip strip has an upper chamfered edge and the opposite side has a lower chamfered edge and wherein the placement indicia extend along the upper chamfered edge.

20. A racket handle according to claim 1, wherein at least at the bottom end of the periphery of the hand-grip, integral tacking means are provided for anchoring the grip strip by being pressed into its underside.

21. A racket handle according to claim 20, wherein the tacking means comprises at least one surrounding line of pinpoints or a strip-shaped surrounding roughening with sharp rough points which can be pressed into the underside of the grip strip.

22. A racket grip according to claim 21, wherein said tacking means is also arranged at a top end of the hand-grip.

23. A racket handle according to claim 20, wherein said tacking means in the form of at least one line of pinpoints or rough points extend between the ends of the hand-grip.

24. A racket handle according to claim 23, the tacking means are pinpoints having a height of 0.1 to 0.7 mm.

25. A racket handle according to claim 23, wherein the tacking means are rough points having a height of 0.05 to 0.3 mm.

26. A racket handle according to claim 23, wherein said line of pinpoints or sharp rough points extends spirally about said hand-grip.

27. A racket handle according to claim 20, wherein said integral tacking means comprise pinpoints having a height of 0.1 to 0.7 mm.

28. A racket handle according to claim 20, wherein said integral tacking means comprise sharp rough points having a height of 0.5 to 0.3 mm.

* * * * *